US011669030B2

(12) United States Patent
Endo

(10) Patent No.: US 11,669,030 B2
(45) Date of Patent: Jun. 6, 2023

(54) IMAGE FORMING DEVICE THAT PERFORMS AN OPERATION CORRESPONDING TO A DEFECT OCCURRING IN A FIXING DEVICE AT A DESIRED TIMING

(71) Applicant: TOSHIBA TEC KABUSHIKI KAISHA, Tokyo (JP)

(72) Inventor: Sasuke Endo, Chigasaki Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/578,518

(22) Filed: Jan. 19, 2022

(65) Prior Publication Data

US 2022/0260944 A1 Aug. 18, 2022

(30) Foreign Application Priority Data

Feb. 18, 2021 (JP) ..... JP2021-024372

(51) Int. Cl.
*G03G 15/20* (2006.01)
*G03G 15/00* (2006.01)

(52) U.S. Cl.
CPC ..... *G03G 15/2032* (2013.01); *G03G 15/205* (2013.01); *G03G 15/2064* (2013.01); *G03G 15/5008* (2013.01)

(58) Field of Classification Search
CPC ..... G03G 15/205; G03G 15/5008
See application file for complete search history.

(56) References Cited

U.S. PATENT DOCUMENTS

| | | | | |
|---|---|---|---|---|
| 7,110,689 | B2 * | 9/2006 | Takahashi | G03G 15/2028 399/68 |
| 2008/0298824 | A1 | 12/2008 | Kanno | |
| 2011/0222881 | A1 | 9/2011 | Yamada | |
| 2013/0336671 | A1 * | 12/2013 | Tamaki | G03G 15/2028 399/67 |
| 2018/0059593 | A1 | 3/2018 | Ishiguro | |
| 2020/0073301 | A1 * | 3/2020 | Sakai | G03G 15/2053 |

FOREIGN PATENT DOCUMENTS

| | | | | |
|---|---|---|---|---|
| JP | 2002-008845 | | 1/2002 | |
| JP | 2013114132 | A * | 6/2013 | G03G 15/2053 |
| JP | 2017-040801 | | 2/2017 | |

* cited by examiner

*Primary Examiner* — Arlene Heredia
(74) *Attorney, Agent, or Firm* — Amin, Turocy & Watson, LLP

(57) ABSTRACT

Provided is an image forming device capable of performing an operation corresponding to a defect occurring in a fixing device at a desired timing. The image forming device includes a conveyance unit, an image forming unit, a fixing device, a motor, and a control unit. The motor drives the fixing device and outputs a signal having a magnitude corresponding to a value of a drive current. The control unit, when conveyance of a print medium is stopped and when the motor is driven in a first operation mode, continues to drive the motor in the first operation mode, and performs a first operation when the magnitude of the signal is out of a first range, and when the conveyance of the print medium is stopped and when the motor is driven in a second operation mode, stops driving the motor in the second operation mode and then drives the motor in the first operation mode, and performs the first operation when the magnitude of the signal is out of the first range.

18 Claims, 7 Drawing Sheets

IMAGE FORMING DEVICE THAT PERFORMS AN OPERATION CORRESPONDING TO A DEFECT OCCURRING IN A FIXING DEVICE AT A DESIRED TIMING

CROSS-REFERENCE TO RELATED APPLICATION

This application is based upon and claims the benefit of priority from Japanese Patent Application No. 2021-024372, filed on Feb. 18, 2021, the entire contents of which are incorporated herein by reference.

FIELD

This disclosure relates to an image forming device, an image forming method, and a control system.

BACKGROUND

In related arts, there has been known an image forming device capable of detecting a value of a parameter indicating a state of a motor that drives a fixing device and determining whether a defect occurs in the fixing device according to the detected value of the parameter. The parameter indicating the state of the motor is, for example, a torque of the motor, a drive current of the motor, or the like.

However, the value of the parameter indicating the state of the motor varies depending on a rotation speed of the motor and the like. For this reason, in the image forming device as described above, for example, when the motor is driven at a rotation speed different from a predetermined rotation speed, it may be difficult to accurately determine whether a defect occurs in the fixing device. As a result, in some cases, the image forming device cannot perform an operation corresponding to a defect occurring in the fixing device at a desired timing.

DETAILED DESCRIPTION

Figure 1:
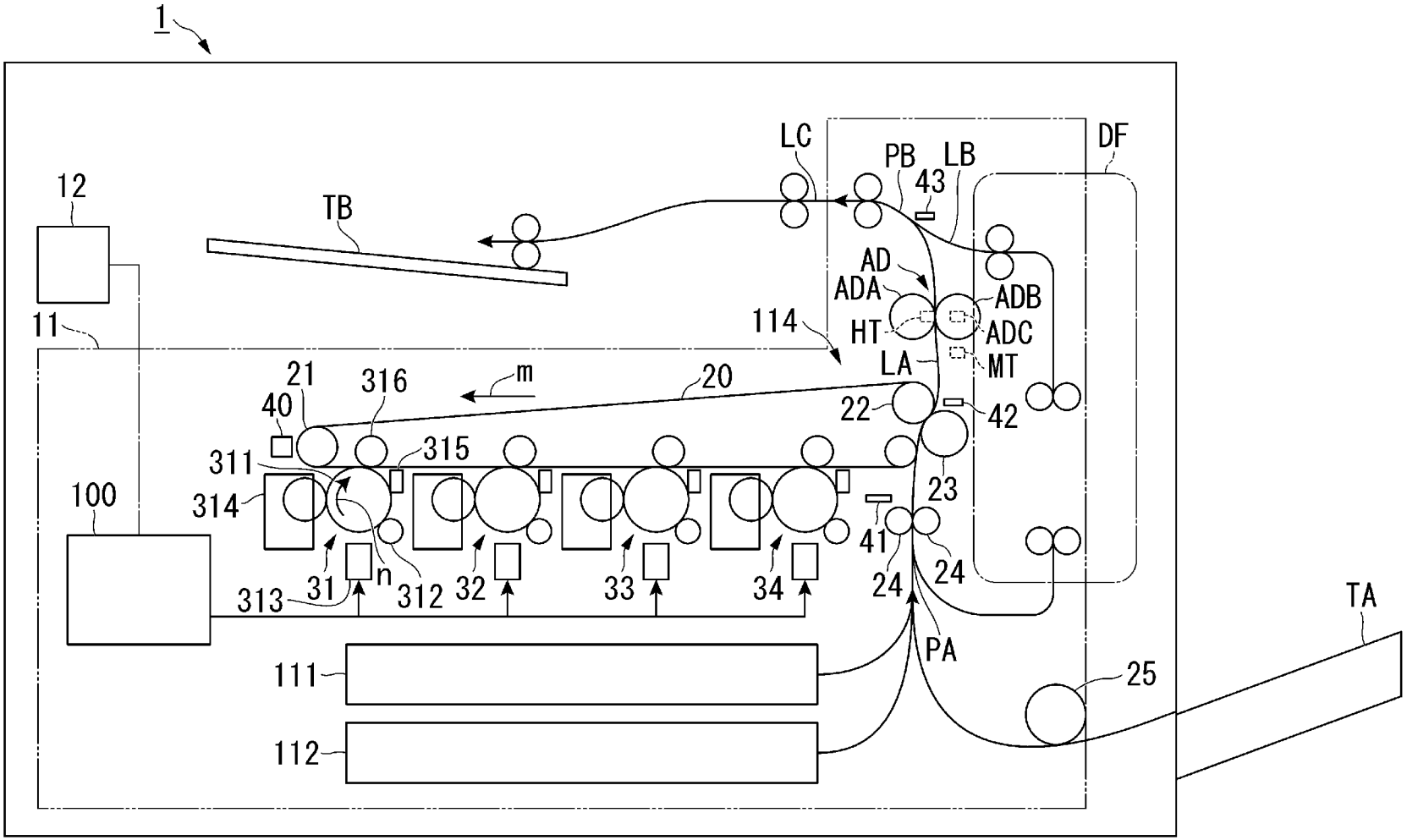
FIG. 1 is a diagram showing an example of a configuration of an image forming device 1.

In general, according to one embodiment, there is provided an image forming device capable of performing an operation corresponding to a defect occurring in a fixing device at a desired timing.

An image forming device according to an embodiment includes a conveyance unit, an image forming unit, a fixing device, a motor, and a control unit. The conveyance unit is configured to convey a print medium. The image forming unit is configured to form a toner image of a target image on the print medium conveyed by the conveyance unit. The fixing device is configured to heat the print medium on which the toner image is formed by the image forming unit, and fix the toner image as the target image to the print medium. The motor is configured to drive the fixing device and output a signal having a magnitude corresponding to a value of a drive current. The control unit is configured to: drive the motor in a first operation mode and a second operation mode different from the first operation mode, when conveyance of the print medium is stopped during a period from reception of an instruction to form the target image on the print medium to completion of the conveyance of the print medium according to the instruction and when the motor is driven in the first operation mode, continue to drive the motor in the first operation mode, and perform a first operation when the magnitude of the signal is out of a first range, and when the conveyance of the print medium is stopped during the period from the reception of the instruction to the completion of the conveyance of the print medium according to the instruction and when the motor is driven in the second operation mode, stop driving the motor in the second operation mode and then drive the motor in the first operation mode, and perform the first operation when the magnitude of the signal is out of the first range.

An image forming device according to an embodiment will be described with reference to drawings. In the drawings, same components are denoted by same reference numerals.

(Overview of Image Forming Device) An overview of an image forming device according to the embodiment will be described.

An image forming device according to an embodiment includes a conveyance unit, an image forming unit, a fixing device, a motor, and a control unit. The conveyance unit conveys a print medium. The image forming unit forms a toner image of a target image on the print medium conveyed by the conveyance unit. The fixing device heats the print medium on which the toner image is formed by the image forming unit, and fixes the toner image as the target image to the print medium. The motor drives the fixing device and outputs a signal having a magnitude corresponding to a value of a drive current. The control unit drives the motor in a first operation mode and a second operation mode different from the first operation mode, when conveyance of the print medium is stopped during a period from reception of an instruction to form the target image on the print medium to completion of the conveyance of the print medium according to the instruction and when the motor is driven in the first operation mode, continues to drive the motor in the first operation mode, and performs a first operation when the magnitude of the signal is out of a first range, and when the conveyance of the print medium is stopped during the period from the reception of the instruction to the completion of the conveyance of the print medium according to the instruction and when the motor is driven in the second operation mode, stops driving the motor in the second operation mode and then drives the motor in the first operation mode, and performs the first operation when the magnitude of the signal is out of the first range.

Therefore, the image forming device according to the embodiment can perform an operation corresponding to a defect occurring in the fixing device at a desired timing.

(Configuration of Image Forming Device) The configuration of the image forming device according to the embodiment will be described. An image forming device 1 will be described as an example of the image forming device. FIG. 1 is a diagram showing an example of the configuration of the image forming device 1.

The image forming device 1 is a device that forms an image on a print medium. For example, the image forming device 1 is a multifunction peripheral, a copier, a printer, or the like. The print medium is a medium on which processing such as image formation is performed by the image forming device 1. The print medium may be any medium as long as the medium is a sheet-like medium capable of having an image formed on at least one of both sides. For example, the printing medium is a printing sheet, a plastic film, or the like.

The image forming device 1 includes, for example, a printer unit 11, a control panel 12, a manual feed tray TA, and a sheet discharge tray TB. The image forming device 1 may include other members, other devices, and the like in addition to the printer unit 11, the control panel 12, the manual feed tray TA, and the sheet discharge tray TB.

The printer unit 11 includes a control unit 100, a paper feed cassette 111, a paper feed cassette 112, and an image forming unit 114.

The control unit 100 controls the entire image forming device 1. In other words, the control unit 100 controls each of the printer unit 11, the control panel 12, and the image forming unit 114.

The paper feed cassette 111 stores a print medium of a type desired by a user. For example, the paper feed cassette 111 stores A4-size plain paper.

The paper feed cassette 112 stores a print medium of a type desired by the user. For example, the paper feed cassette 112 stores A4-size thick paper.

The control panel 12 includes an operation receiving unit and a display unit.

The operation receiving unit receives an operation from the user. The operation receiving unit is an input device. For example, the operation receiving unit is a touch pad, an input key, or the like. When the operation receiving unit receives an operation from the user, the operation receiving unit outputs information indicating the received operation to the control unit 100.

The display unit displays an image corresponding to the operation received via the operation receiving unit. The display unit is an image display device. For example, the display unit is a liquid crystal display, an organic electroluminescence (EL) display, or the like. The display unit may be integrally formed with the operation receiving unit as a touch panel.

The image forming unit 114 conveys the print medium and forms an image indicated by the image data acquired from the control unit 100 on the print medium under the control of the control unit 100. For convenience of explanation, forming an image on a print medium is referred to as printing. The image forming unit 114 is an example of the image forming unit.

(Configuration of Image Forming Unit) The configuration of the image forming unit 114 will be described.

The image forming unit 114 includes an intermediate transfer belt 20. The image forming unit 114 includes a driven roller 21, a backup roller 22, a secondary transfer roller 23, two registration rollers 24, and a manual feed roller 25. The image forming unit 114 includes four image forming stations, i.e., an image forming station 31, an image forming station 32, an image forming station 33, and an image forming station 34. The image forming unit 114 includes a belt cleaner 40, a first detecting unit 41, a second detecting unit 42, and a third detecting unit 43. The image forming unit 114 includes a fixing device AD, a motor MT, and a duplex printing device DF.

The intermediate transfer belt 20 is a belt onto which toner images are primarily transferred by the four image forming stations. That is, a toner image is formed on the intermediate transfer belt 20. The intermediate transfer belt 20 is supported by a driven roller 21, a backup roller 22, and the like. The intermediate transfer belt 20 rotates in a direction indicated by an arrow m in FIG. 1. More specifically, the image forming unit 114 rotates the intermediate transfer belt 20 in this direction by a motor (not shown) under the control of the control unit 100.

The image forming station 31 is an image forming station for forming a yellow (Y) image. The image forming station 32 is an image forming station for forming a magenta (M) image. The image forming station 33 is an image forming station for forming a cyan (C) image. The image forming station 34 is an image forming station for forming a black (K) image. In the image forming unit 114, the four image forming stations are disposed below the intermediate transfer belt 20 along the rotation direction of the intermediate transfer belt 20.

The image forming station 31 includes a photoconductor drum 311, an electrostatic charger 312, an exposure scanning head 313, a developing device 314, a photoconductor cleaner 315, and a primary transfer roller 316. In the image forming station 31, the electrostatic charger 312, the exposure scanning head 313, the developing device 314, the photoconductor cleaner 315, and the primary transfer roller 316 are disposed around the photoconductor drum 311 which rotates in a direction indicated by an arrow n in FIG. 1. The primary transfer roller 316 faces the photoconductor drum 311 with the intermediate transfer belt 20 interposed therebetween.

Configurations of the image forming station 32, the image forming station 33, and the image forming station 34 are similar as the configuration of the image forming station 31. Therefore, in the following, descriptions of the configurations of the image forming station 32, the image forming station 33, and the image forming station 34 are omitted.

The secondary transfer roller 23 faces the backup roller 22 with the intermediate transfer belt 20 interposed therebetween. The secondary transfer roller 23 secondarily transfers the toner image primarily transferred to the intermediate transfer belt 20 to a print medium passing between the secondary transfer roller 23 and the intermediate transfer belt 20.

The two registration rollers 24 transport, between the secondary transfer roller 23 and the intermediate transfer belt 20, the print medium taken out from each of the paper feed cassette 111, the paper feed cassette 112, and the manual feed tray TA by a convey mechanism (not shown).

The manual feed roller 25 takes out the print medium from the manual feed tray TA and conveys the print medium to the two registration rollers 24.

The belt cleaner 40 removes the toner remaining on the intermediate transfer belt 20 under the control of the control unit 100.

The first detecting unit 41 is a sensor that detects that the print medium passes between the two registration rollers 24. In the embodiment, the print medium passing between the two registration rollers 24 means that the print medium is conveyed by the two registration rollers 24. The first detecting unit 41 is provided at a position where the first detecting unit 41 can detect that the print medium passes between the two registration rollers 24. The first detecting unit 41 is, for example, an optical sensor. The first detecting unit 41 may be another sensor capable of detecting that the print medium passes between the two registration rollers 24, instead of the optical sensor. When the first detecting unit 41 detects that the print medium passes between the two registration rollers 24, the first detecting unit 41 outputs information indicating that the print medium passes between the two registration rollers 24 to the control unit 100.

The second detecting unit 42 is a sensor that detects that the print medium passes between the secondary transfer roller 23 and the intermediate transfer belt 20. In the embodiment, the print medium passing between the secondary transfer roller 23 and the intermediate transfer belt 20 means that the print medium is conveyed by the secondary transfer roller 23. The second detecting unit 42 is provided at a position where the second detecting unit 42 can detect that the print medium passes between the secondary transfer roller 23 and the intermediate transfer belt 20. The second detecting unit 42 is, for example, an optical sensor. The second detecting unit 42 may be another sensor capable of detecting that the print medium passes between the secondary transfer roller 23 and the intermediate transfer belt 20, instead of the optical sensor. When the second detecting unit 42 detects that the print medium passes between the secondary transfer roller 23 and the intermediate transfer belt 20, the second detecting unit 42 outputs information indicating that the print medium passes between the secondary transfer roller 23 and the intermediate transfer belt 20 to the control unit 100.

The third detecting unit 43 is a sensor that detects that the print medium is discharged to the sheet discharge tray TB. For example, the third detecting unit 43 detects that the print medium passes through a predetermined first position between the fixing device AD and the sheet discharge tray TB among positions on a conveyance path on which the print medium is conveyed as that the print medium is discharged to the sheet discharge tray TB. The third detecting unit 43 is provided at a position where the third detecting unit 43 can detect that the print medium passes through the first position. The third detecting unit 43 is, for example, an optical sensor. The third detecting unit 43 may be another sensor capable of detecting that the print medium is discharged to the sheet discharge tray TB, instead of the optical sensor. When the third detecting unit 43 detects that the print medium is discharged to the sheet discharge tray TB, the third detecting unit 43 outputs information indicating that the print medium is detected to be discharged to the discharge tray TB to the control unit 100.

The fixing device AD includes a fixing member ADA, a heating unit HT, a pressing member AD, and a pressing adjustment mechanism ADC.

The fixing member ADA is a member having an endless peripheral surface. For example, the fixing member ADA is a belt-shaped member. The fixing member ADA is in contact with an outer peripheral surface of the pressing member ADB. The fixing member ADA rotates together with the pressing member ADB. The heating unit HT is provided inside the fixing member ADA. A support member that rotatably supports the fixing member ADA is provided inside the fixing member ADA. In FIG. 1, the support member is omitted in order to simplify the drawing.

The heating unit HT heats the fixing member ADA. For example, the heating unit HT includes a heater and a heating target member that is to be heated by the heater. In this case, the heating target member to be heated is slidably in contact with the fixing member ADA. The heating unit HT heats the heating target member by the heater and heats the fixing member ADA in contact with the heating target member.

The pressing member ADB is a roller that comes into contact with the outer peripheral surface of the fixing member ADA. A driving force of the motor MT is transmitted to the pressing member ADB via a gear or the like. In other words, the pressing member ADB is rotated by driving the motor MT.

The pressing member ADB is pressed against the outer peripheral surface of the fixing member ADA by a biasing member such as a spring. The pressing member ADB forms a nip together with the fixing member ADA by being pressed against the fixing member ADA. In other words, the pressing member ADB forms a nip together with the fixing member ADA by coming into contact with the fixing member ADA. The force with which the pressing member ADB is pressed against the fixing member ADA by the biasing member is adjusted by the control unit 100 via the pressing adjustment mechanism ADC. For convenience of description, the force will be referred to as a pressing force. In the fixing device AD, instead of the configuration in which the pressing member ADB is pressed against the outer peripheral surface of the fixing member ADA by the biasing member, the fixing member ADA may be pressed against the outer peripheral surface of the pressing member ADB by the biasing member. In this case, the pressing force is a force by which the fixing member ADA is pressed against the pressing member ADB by the biasing member.

The pressing adjustment mechanism ADC moves the pressing member ADB in a direction away from the fixing member ADA and adjusts a pressing force according to the control from the control unit 100. For example, the pressing adjustment mechanism ADC moves the pressing member ADB in a direction away from the fixing member ADA, and separates the pressing member ADB from the fixing member ADA. In this case, the pressing force is 0 N. For example, the pressing adjustment mechanism ADC moves the pressing member ADB in a direction away from the fixing member ADA, and causes the pressing force to match a force according to the control from the control unit 100. In the configuration in which the fixing member ADA is pressed against the outer peripheral surface of the pressing member ADB by the biasing member, the pressing adjustment mechanism ADC moves the fixing member ADA in a direction away from the pressing member ADB and adjusts the pressing force according to the control from the control unit 100.

The fixing device AD is a device that fixes the toner image to the print medium after the toner image is secondarily transferred by the secondary transfer roller 23. More specifically, the fixing device AD pressurizes and heats the printing medium while the printing medium is being conveyed by the fixing member ADA and the pressing member ADB. Therefore, the fixing device AD fixes, to the print medium, the toner image secondarily transferred to the print medium. As a result, the image is formed on the print medium.

The motor MT drives the fixing device AD. The motor MT includes a circuit that outputs, to the control unit 100, a signal having a magnitude corresponding to a value of a drive current of the motor MT. The circuit may be any circuit as long as the circuit can output the signal to the control unit 100. The motor MT is, for example, a servo motor. The motor MT rotates the pressing member ADB via a gear or the like. The motor MT may be a motor of another type that can be controlled by the control unit 100, instead of the servo motor.

The duplex printing device DF is a device that conveys the print medium whose front surface is formed with the image by the fixing device AD to the two registration rollers 24. The printing medium whose front surface and back surface are turned over is conveyed to the duplex printing device DF. Therefore, the print medium conveyed between the two registration rollers 24 by the duplex printing device DF has an image formed on the back surface thereof by the secondary transfer roller 23 and the fixing device AD.

(Operation of Image Forming Unit) The operation of the image forming unit 114 will be described.

First, the operation of the four image forming stations will be described by taking the operation of the image forming station 31 as an example.

In the image forming station 31, the photoconductor drum 311 is charged by the electrostatic charger 312, and then exposed by the exposure scanning head 313. Therefore, the image forming station 31 forms an electrostatic latent image on the photoconductor drum 311. Thereafter, the image forming station 31 causes the developing device 314 to develop the electrostatic latent image on the photoconductor drum 311. The developing device 314 develops the electrostatic latent image on the photoconductor drum 311 as a toner image using a two-component developer formed from a toner and a carrier. As described above, the toner image is formed on the photoconductor drum 311. The primary transfer roller 316 primarily transfers the toner image formed on the photoconductor drum 311 to the intermediate transfer belt 20. After the primary transfer is performed, the photoreceptor cleaner 315 removes toner remaining on the photoconductor drum 311.

Each of the image forming station 31, the image forming station 32, the image forming station 33, and the image forming station 34 forms a color toner image on the intermediate transfer belt 20 by the primary transfer roller 316. The color toner image is formed by sequentially superimposing yellow (Y), magenta (M), cyan (C), and black (K) toner images.

Next, the operation of the secondary transfer roller 23 will be described. The secondary transfer roller 23 secondarily transfers the color toner images on the intermediate transfer belt 20 in a collective manner to the print medium passing between the secondary transfer roller 23 and the intermediate transfer belt 20. In the following description, the term "toner image" may be either the color toner image or a toner image of only one color. The toner image may be a toner image using a decolorable toner.

Next, among the operations of the image forming unit 114, an operation of conveying the print medium will be described.

At the nip between the two registration rollers 24, the print medium taken out from each of the paper feed cassette 111, the paper feed cassette 112, and the manual feed tray TA is bent by a convey mechanism (not shown). Thereby, a position of a leading end of the print medium is adjusted. Thereafter, the two registration rollers 24 convey the print medium between the secondary transfer roller 23 and the intermediate transfer belt 20 in accordance with the timing at which the image forming unit 114 transfers the toner image to the print medium. The conveyance paths along which the print medium taken out from the paper feed cassette 111, the paper feed cassette 112, and the manual feed tray TA is conveyed to the two registration rollers 24 merge at a merging point PA shown in FIG. 1.

In the image forming unit 114, three conveyance paths, that is, a conveyance path LA, a conveyance path LB, and a conveyance path LC are formed by the two registration rollers 24, the fixing device AD, and a plurality of rollers in the duplex printing device DF. The conveyance path LA is a conveyance path from the merging portion PA to a branch portion PB shown in FIG. 1. The conveyance path LB is a conveyance path that passes through an inside of the duplex printing device DF, and is a conveyance path from the branch portion PB to the merging portion PA. The conveyance path LC is a conveyance path from the branch portion PB to the sheet discharge tray TB.

The two registration rollers 24 start rotating in accordance with a position of the toner image on the rotating intermediate transfer belt 20, and move the print medium to the position of the secondary transfer roller 23. Therefore, the toner image formed on the intermediate transfer belt 20 is secondarily transferred to the print medium by the secondary transfer roller 23. After the toner image is secondarily transferred to the print medium, the secondary transfer roller 23 conveys the print medium to the fixing device AD along the conveyance path LA. The fixing device AD fixes the toner image secondarily transferred to the print medium conveyed from the secondary transfer roller 23 to the print medium while conveying the print medium. Thereby, the toner image that is secondarily transferred is formed as an image on the print medium. The fixing device AD conveys the print medium to the conveyance path LC after the image is formed on the print medium. The print medium conveyed to the conveyance path LC is discharged by a roller (not shown).

In the case of duplex printing, after an image is formed on the front surface and the entire print medium passes through the branch portion PB, a roller (not shown) conveys the print medium to the conveyance path LB by switchback. Therefore, the front surface and the back surface of the print medium are turned over. Thereafter, the plurality of rollers in the duplex printing device DF convey the print medium to the nip between the two registration rollers 24 along the conveyance path LB. Then, the print medium whose front surface and back surface are turned over is conveyed along the conveyance path LA via the two registration rollers 24, and the toner image is fixed by the fixing device AD. Thereby, the image is formed on the back surface of the print medium. The fixing device AD conveys the print medium having the image formed on the back surface thereof to the conveyance path LC and discharges the print medium.

As described above, the secondary transfer roller 23, the two registration rollers 24, the fixing device AD, and various rollers in the duplex printing device DF constitute a conveyance unit that conveys the print medium in the image forming device 1.

Figure 2:
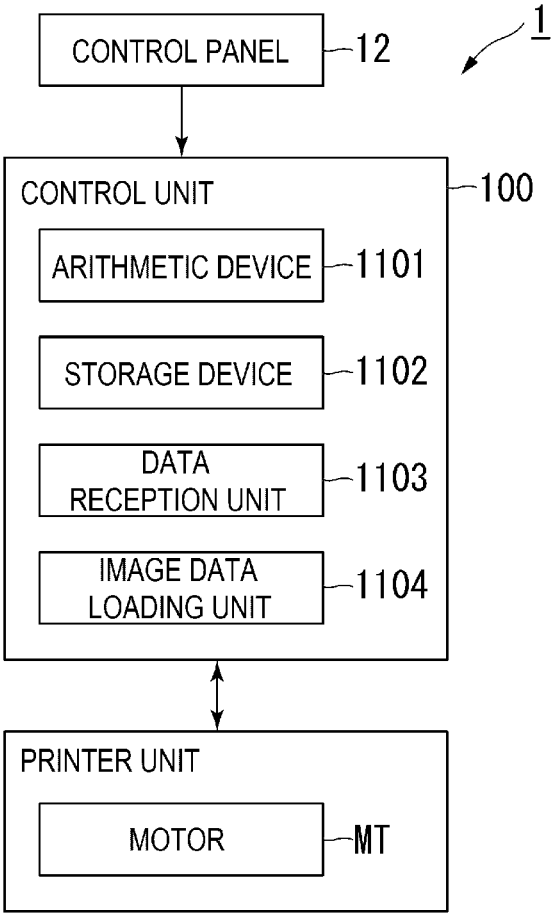
FIG. 2 is a diagram showing an example of a functional configuration of a control unit 100.

(Functional Configuration of Control Unit) The functional configuration of the control unit 100 will be described with reference to FIG. 2. FIG. 2 is a diagram showing an example of the functional configuration of the control unit 100.

As shown in FIG. 2, the control unit 100 is communicably connected to each of the printer unit 11 and the control panel 12. The control unit 100 includes an arithmetic device 1101, a storage device 1102, a data reception unit 1103, and an image data loading unit 1104.

The arithmetic device 1101 is, for example, a central processing unit (CPU), an application specific integrated circuit (ASIC), or the like. The arithmetic device 1101 controls each of the printer unit 11 and the control panel 12 in accordance with an image processing program stored in the storage device 1102.

The storage device 1102 is a read only memory (ROM), a random access memory (RAM), a hard disk drive (HDD), a solid state drive (SSD), or the like. The storage device 1102 may be separate from the control unit 100.

The data reception unit 1103 receives print data (for example, data described in a page description language) indicating an image to be printed from a host such as a personal computer (PC), and stores the received print data in the storage device 1102.

The image data loading unit 1104 determines print conditions from the print data stored in the storage device 1102 by the data reception unit 1103, and thereby loads the print data into data that can be printed (for example, raster data) by the printer unit 11, and stores the data in the storage device 1102.

(Operation Modes of Image Forming Device) Hereinafter, the operation modes of the image forming device 1 will be described. The image forming device 1 can perform an operation of forming an image on a print medium in any one of a plurality of operation modes according to a type of the print medium. As an example, a case where the image forming device 1 performs an operation of forming an image on a print medium in one of a first operation mode and a second operation mode according to the type of the print medium will be described.

The first operation mode is an operation mode in which the motor MT is driven at a first rotation speed. For example, when forming an image on an A4 size plain paper, the image forming device 1 performs an operation of forming an image on the plain paper in the first operation mode. The first rotation speed is, for example, 1500 rpm. The first rotation speed may be a rotation speed lower than 1500 rpm or may be a rotation speed higher than 1500 rpm.

The second operation mode is an operation mode in which the motor MT is driven at a second rotation speed. For example, when forming an image on an A4 size thick paper, the image forming device 1 performs an operation of forming an image on the thick paper in the second operation mode. The second rotation speed is, for example, 940 rpm. The second rotation speed may be a rotation speed lower than 940 rpm or may be a rotation speed higher than 940 rpm.

Figure 3:
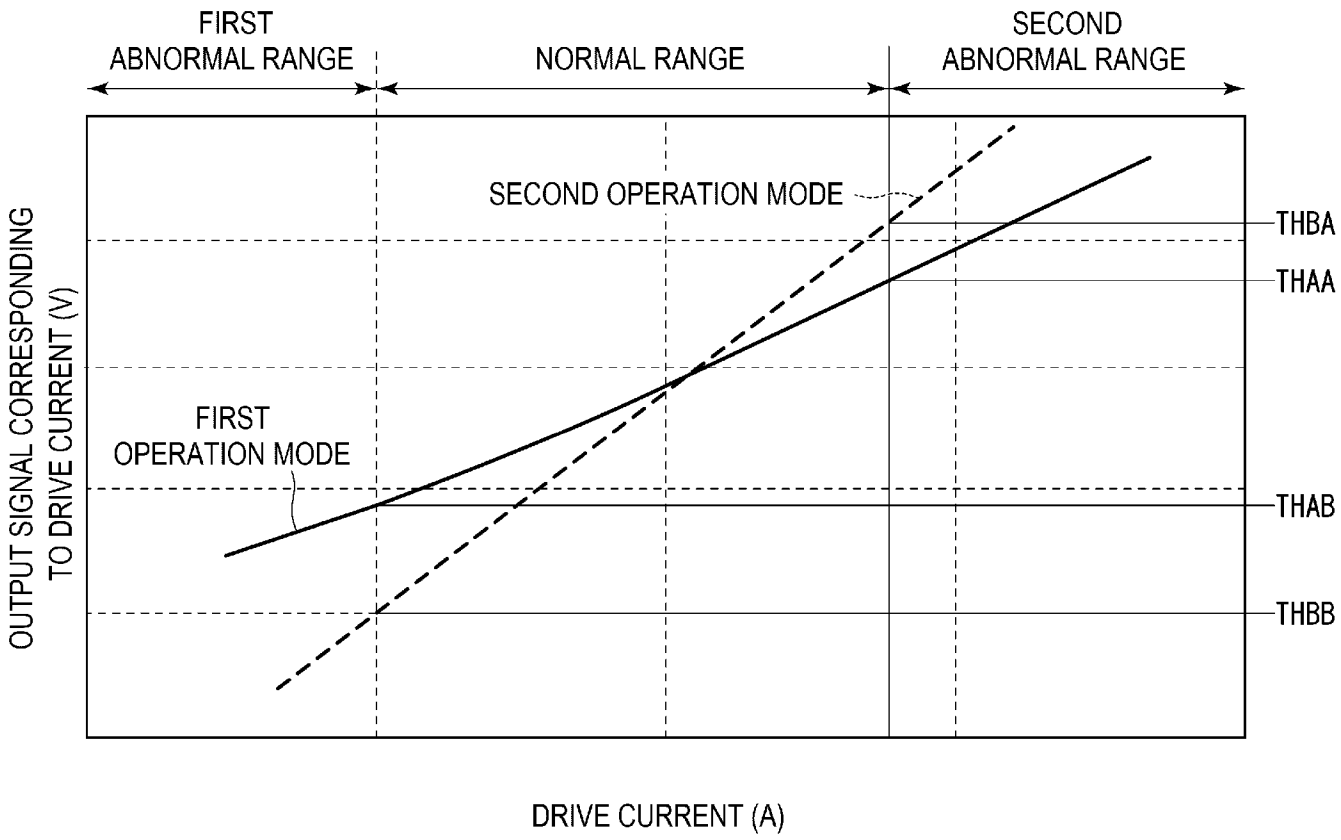
FIG. 3 is a diagram showing an example of a first correspondence relationship.

(Relationship between Value of Drive Current of Motor and Magnitude of Signal Output from Motor) The relationship between the value of the drive current of the motor MT and the magnitude of the signal output from the motor MT will be described. For convenience of explanation, the value of the drive current of the motor MT will be referred to as a drive current value. For convenience of explanation, the signal is referred to as a motor signal. For convenience of explanation, the magnitude of the motor signal is referred to as a motor signal value. For convenience of explanation, the relationship between the drive current value and the motor signal value will be referred to as a first correspondence relationship. FIG. 3 is a diagram showing an example of the first correspondence relationship.

A horizontal axis of the graph shown in FIG. 3 represents the drive current value. The drive current value changes according to a load of the motor MT. For example, when the fixing device AD driven by the motor MT is operating normally, the drive current value indicates a value within a normal range shown in FIG. 3. For example, when the fixing member ADA and the pressing member ADB are in abutment failure with each other in the fixing device AD driven by the motor MT, the drive current value indicates a value within a first abnormal range shown in FIG. 3. For example, when a lubricant in the fixing member ADA is depleted in the fixing device AD driven by the motor MT, the drive current value indicates a value within a second abnormal range shown in FIG. 3.

A vertical axis of the graph shown in FIG. 3 represents the motor signal value. The motor signal value changes according to a combination of the drive current value and the rotation speed of the motor MT. A solid line plotted on the graph indicates the first correspondence relationship when the image forming device 1 operates in the first operation mode. A dotted line plotted on the graph indicates the first correspondence relationship when the image forming device 1 operates in the second operation mode.

As shown in FIG. 3, when the image forming device 1 operates in the first operation mode and when the image forming device 1 operates in the second operation mode, motor signal values corresponding to a drive current value indicating a boundary between the normal range and the first abnormal range are different from each other. In the example shown in FIG. 3, the motor signal value corresponding to the drive current value indicating the boundary when the image forming device 1 operates in the first operation mode is larger than the motor signal value corresponding to the drive current value indicating the boundary when the image forming device 1 operates in the second operation mode. In FIG. 3, the motor signal value corresponding to the drive current value indicating the boundary when the image forming device 1 is operating in the first operation mode is indicated by a threshold value THAB. In FIG. 3, the motor signal value corresponding to the drive current value indicating the boundary when the image forming device 1 is operating in the second operation mode is indicated by a threshold value THBB. On the other hand, in the example, a motor signal value corresponding to the drive current value indicating a boundary when the image forming device 1 operates in the second operation mode is smaller than the motor signal value corresponding to the drive current value indicating the boundary when the image forming device 1 operates in the first operation mode. In FIG. 3, the motor signal value corresponding to the drive current value indicating the boundary when the image forming device 1 is operating in the first operation mode is indicated by a threshold value THAA. In FIG. 3, the motor signal value corresponding to the drive current value indicating the boundary when the image forming device 1 is operating in the second operation mode is indicated by a threshold value THBA. For convenience of explanation, a range from the threshold value THAA to the threshold value THAB will be referred to as a first range. For convenience of explanation, a range from the threshold value THBA to the threshold value THBB will be referred to as a second range. The second range is a range at least one of whose upper limit value and lower limit value is different from the first range. In the example shown in FIG. 3, both the upper limit value and the lower limit value of the second range are different from those of the first range.

As described above, even when the first range and the second range are different ranges, the image forming device 1 can perform an operation corresponding to a defect occurring in the fixing device AD at a desired timing. By taking a first operation as an example of such operation, a processing in which the image forming device 1 performs the first operation will be described.

(Processing of Performing First Operation among Processing Performed by Image Forming Device) A processing of performing a first operation among processing performed by the image forming device 1 will be described.

The first operation includes an operation related to a motor signal value deviating from the first range among the operations performed by the image forming device 1 in the first operation mode. For example, the first operation includes an operation of outputting notification information to an information processing device communicably connected to the image forming device 1. The notification in formation includes, for example, information indicating that the motor signal value is out of the first range, information indicating that a defect occurs in the fixing device AD, and the like. For example, the first operation includes an operation of stopping the formation of the image on the print medium. For example, the first operation includes an operation of stopping the driving of the fixing device AD. The first operation may include another operation instead of a part or all of the operations or in addition to all of the operations.

Figure 4:
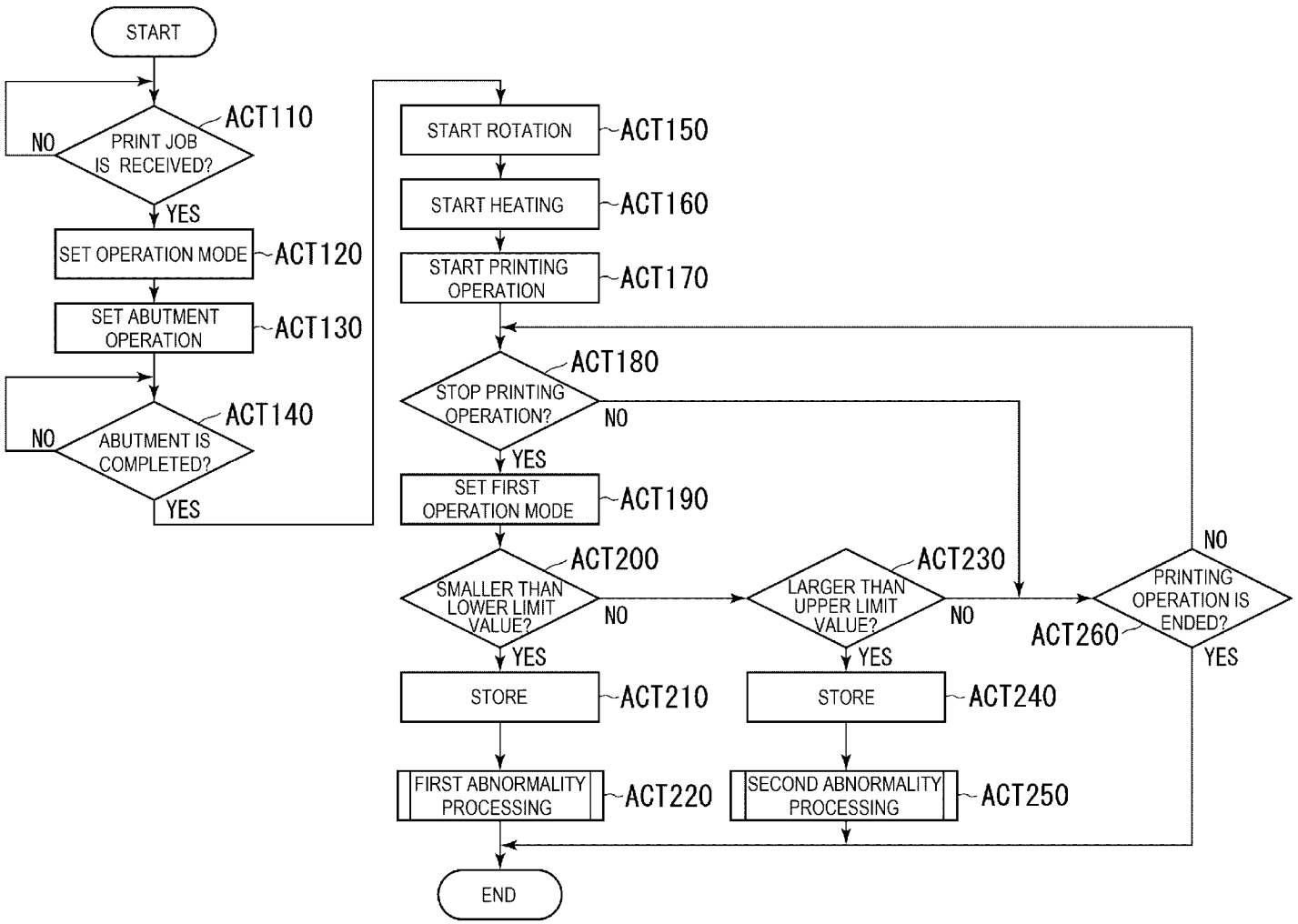
FIG. 4 is a diagram showing an example of a flow of a processing of performing a first operation.

FIG. 4 is a diagram showing an example of a flow of the processing of performing the first operation among processing performed by the image forming device 1. For convenience of explanation, the image formed on the print medium by the image forming device 1 will be referred to as the target image.

The control unit 100 waits until a print job is received (ACT 110). The print job is an example of an instruction to form the target image on the print medium. The print job includes, for example, information indicating the instruction and information indicating the type of the print medium on which the target image is to be formed. The print job may include other information in addition to such information.

If it is determined that the print job is received (Yes in ACT 110), the control unit 100 specifies the type of the print medium on which the target image is to be formed based on the information included in the print job. After the type is specified, the control unit 100 sets the operation mode of the image forming device 1 to the operation mode according to the specified type (ACT 120). For example, in ACT 120, when the identified type is A4 plain paper, the control unit 100 sets the operation mode of the image forming device 1 to the first operation mode. For example, in ACT 120, when the identified type is A4 thick paper, the control unit 100 sets the operation mode of the image forming device 1 to the second operation mode.

Next, the control unit 100 starts an abutment operation (ACT 130). The abutment operation is an operation of abutting the pressing member ADB against the outer peripheral surface of the fixing member ADA in the fixing device AD among the operations performed by the image forming device 1. In ACT 120, the control unit 100 controls the pressing adjustment mechanism ADC to start the abutment operation.

Next, the control unit 100 waits until the abutment operation started in ACT 130 is completed (ACT 140). For example, when the pressing force matches a predetermined force, the control unit 100 determines that the abutment operation is completed. For example, the control unit 100 may detect the pressing force using a pressure sensor, may detect the pressing force using a position of the pressing member ADB, or may detect the pressing force using another method.

If it is determined that the abutment operation started in ACT 130 is completed (YES in ACT 140), the control unit 100 drives the motor MT at the rotation speed according to the current operation mode of the image forming device 1 and starts the rotation of the pressing member ADB (ACT 150). In other words, the control unit 100 starts driving the fixing device AD in ACT 150. For example, in ACT 150, when the current operation mode of the image forming device 1 is the first operation mode, the control unit 100 drives the motor MT at 1500 rpm. For example, in ACT 150, when the current operation mode of the image forming device 1 is the second operation mode, the control unit 100 drives the motor MT at 940 rpm.

Next, the control unit 100 controls a heater of the heating unit HT to start heating the fixing member ADA (ACT 160).

Next, the control unit 100 starts a printing operation (ACT 170). In the embodiment, the printing operation is an operation including conveyance of the print medium and formation of the target image on the print medium among the operations performed by the image forming device 1. In the flowchart shown in FIG. 4, a description of the flow of the processing of performing the printing operation among the processing performed by the image forming device 1 will be omitted.

Next, the control unit 100 determines whether to stop the printing operation (ACT 180). For example, when a printing operation stop condition is satisfied in step S170, the control unit 100 determines to stop the printing operation. The printing operation stop condition includes, for example, one or more conditions such as reception of an operation to stop the printing operation and output of a stop signal to stop the printing operation due to occurrence of paper jam or the like. When at least one of the one or more conditions included in the printing operation stop condition is satisfied, the control unit 100 determines that the printing operation stop condition is satisfied. On the other hand, when none of one or more conditions included in the printing operation stop condition is not satisfied, the control unit 100 determines that the printing operation stop condition is not satisfied.

If it is determined not to stop the printing operation (No in ACT 180), the control unit 100 determines whether the printing operation started in ACT 170 is ended (ACT 260). For example, when the control unit 100 acquires, from the third detecting unit 43, information indicating that the discharge of the print medium to the sheet discharge tray TB is detected, the control unit 100 determines that the printing operation is ended. On the other hand, for example, when the control unit 100 does not acquire, from the third detecting unit 43, information indicating that the discharge of the print medium to the sheet discharge tray TB is detected, the control unit 100 determines that the printing operation is not ended. The control unit 100 may determine whether the printing operation is ended by another method. The determination in ACT 260 can be rephrased as determination as to whether the image forming device 1 finishes the conveyance of the print medium according to the print job received in ACT 110.

If it is determined that the printing operation started in ACT 170 is not ended (NO in ACT 260), the control unit 100 transitions to ACT 180 and determines again whether to stop the printing operation.

On the other hand, when it is determined that the printing operation started in ACT 170 is ended (YES in ACT 260), the control unit 100 ends the processing of the flowchart shown in FIG. 4.

On the other hand, when it is determined to stop the printing operation (Yes in ACT 180), the control unit 100 sets the current operation mode of the image forming device 1 to the first operation mode (ACT 190). For example, when the current operation mode of the image forming device 1 in ACT 180 is the first operation mode, the control unit 100 keeps the current operation mode of the image forming device 1 as the first operation mode in ACT 190. In other words, for example, in this case, the control unit 100 continues to drive the motor MT in the first operation mode in ACT 190. On the other hand, for example, when the current operation mode of the image forming device 1 in ACT 180 is the second operation mode, the control unit 100 resets the current operation mode of the image forming device 1 to the first operation mode in ACT 190. In other words, for example, in this case, the control unit 100 stops the driving of the motor MT in the second operation mode and then starts driving the motor MT in the first operation mode in ACT 190.

Next, the control unit 100 acquires the motor signal, and determines whether the motor signal value of the acquired motor signal is smaller than the threshold value THAB which is the lower limit value of the above-described first range (ACT 200). The lower limit value may be set in advance in the control unit 100 or may be stored in the storage device 1102.

If it is determined that the motor signal value of the acquired motor signal is smaller than the lower limit value of the first range (Yes in ACT 200), the control unit 100 stores abutment failure information in the storage device 1102 (ACT 210). The abutment failure information is information including information indicating that an abutment failure between the fixing member ADA and the pressing member ADB occurs in the fixing device AD driven by the motor MT. The abutment failure information may include other information in addition to the information indicating that the abutment failure between the fixing member ADA and the pressing member ADB occurs in the fixing device AD driven by the motor MT.

Next, the control unit 100 performs a first abnormality processing (ACT 220). The first abnormality processing is a processing of performing an eleventh operation. The eleventh operation is a first operation performed by the image forming device 1 in the first abnormality processing. The flow of processing in which the image forming device 1 performs the first abnormality processing will be described later. After performing the first abnormality processing, the control unit 100 ends the processing of the flowchart shown in FIG. 4.

On the other hand, when it is determined that the motor signal value of the acquired motor signal is equal to or greater than the lower limit value of the first range (No in ACT 200), the control unit 100 determines whether the motor signal value of the acquired motor signal is greater than the threshold value THAA which is the upper limit value of the first range (ACT 230). The upper limit value may be set in advance in the control unit 100 or may be stored in the storage device 1102.

When it is determined that the motor signal value of the acquired motor signal is larger than the upper limit value of the first range (Yes in ACT 230), the control unit 100 stores the lubricant depletion information in the storage device 1102 (ACT 240). The lubricant depletion information is information including information indicating that a lubricant in the fixing member ADA is depleted in the fixing device AD driven by the motor MT. The lubricant depletion information may include other information in addition to the information indicating that the lubricant in the fixing member ADA is depleted in the fixing device AD driven by the motor MT.

Next, the control unit 100 performs a second abnormality processing (ACT 250). The second abnormality processing is a processing of performing a twenty-first operation. The twenty-first operation is a first operation performed by the image forming device 1 in the second abnormality processing. The flow of processing in which the image forming device 1 performs the second abnormality processing will be described later. After performing the second abnormality processing, the control unit 100 ends the processing of the flowchart shown in FIG. 4.

On the other hand, when it is determined that the motor signal value of the acquired motor signal is equal to or less than the upper limit value of the first range (No in ACT 230), the control unit 100 transitions to ACT 260 and determines whether the printing operation started in ACT 170 is ended.

Figure 5:
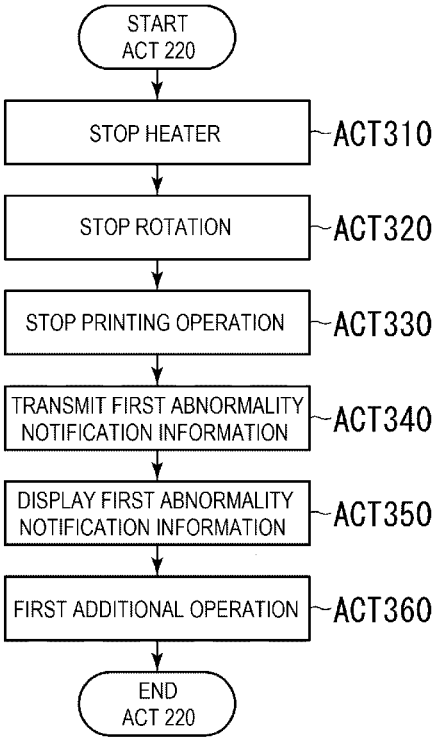
FIG. 5 is a diagram showing an example of a flow of a first abnormality processing in ACT 220.

(First Abnormality Processing) The first abnormality processing will be described. FIG. 5 is a diagram showing an example of a flow of the first abnormality processing performed by a control unit 100 in ACT 220 shown in FIG. 4. The operation of the image forming device 1 performed by each of the processing of ACT 310 to ACT 360 shown in FIG. 5 is an example of the eleventh operation.

The control unit 100 controls a heater of the heating unit HT to stop heating the fixing member ADA (ACT 310).

Next, the control unit 100 controls the motor MT to stop the rotation of the pressing member ADB (ACT 320).

Next, the control unit 100 stops the printing operation started in ACT 170 shown in FIG. 4 (ACT 330).

Next, the control unit 100 transmits first abnormality notification information (ACT 340). The first abnormality notification information is, for example, information including abutment failure information. The first abnormality notification information may include information indicating that the motor signal value is out of the first range in place of the abutment failure information or in addition to the abutment failure information. The first abnormality notification information may include other information in addition to one or both of the two pieces of information. A transmission destination at which the control unit 100 transmits the first abnormality notification information in ACT 340 is an information processing device or the like communicably connected to the image forming device 1. The information processing device is, for example, a personal computer (PC) of a company that performs maintenance of the image forming device 1, an information processing terminal of an administrator who manages the image forming device 1, or the like, but is not limited thereto. The information processing terminal is a multifunctional mobile phone terminal (smartphone), a mobile phone terminal, a tablet PC, a notebook PC, a personal digital assistant (PDA), a desktop PC, or the like, but is not limited thereto. The first abnormality notification information is an example of the notification information described above.

Next, the control unit 100 displays the first abnormality notification information (ACT 350). A display target on which the control unit 100 displays the first abnormality notification information in ACT 350 is the display unit of the control panel 12, a display unit of an information processing device communicably connected to the image forming device 1, or the like. The information processing device is, for example, a PC of a company that performs maintenance of the image forming device 1, an information processing terminal of an administrator who manages the image forming device 1, or the like, but is not limited thereto.

Next, the control unit 100 performs a first additional operation (ACT 360). The first additional operation may be any operation as long as the operation can be additionally performed to the image forming device 1 in addition to the operation of the image forming device 1 performed by the processing of ACT 310 to ACT 350 shown in FIG. 5. After the processing of ACT 360 is performed, the control unit 100 ends the processing of the flowchart shown in FIG. 5.

In the flowchart shown in FIG. 5, apart of the processing in ACT 310 to ACT 360 may be omitted.

In the flowchart shown in FIG. 5, a part or all of the processing in ACT 310 to ACT 360 may be performed in another order or may be performed in parallel.

Figure 6:
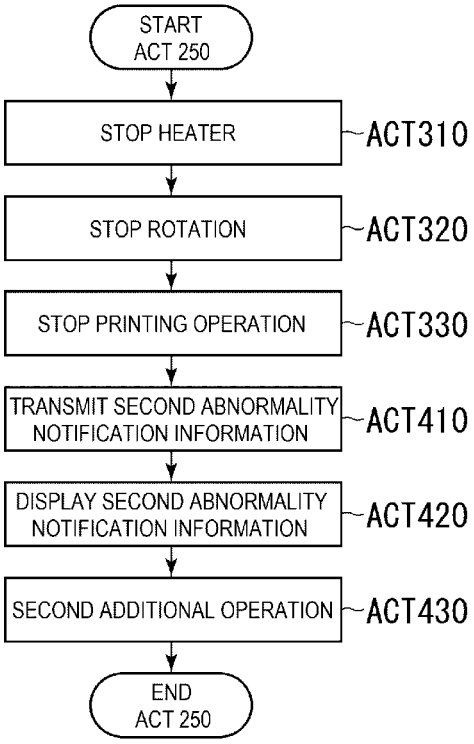
FIG. 6 is a diagram showing an example of a flow of a second abnormality processing in ACT 250.

(Second Abnormality Processing) The second abnormality processing will be described. FIG. 6 is a diagram showing an example of a flow of the second abnormality processing performed by a control unit 100 in ACT 250 shown in FIG. 4. Since ACT 310, ACT 320, and ACT 330 shown in FIG. 6 are the same processing as ACT 310, ACT 320, and ACT 330 shown in FIG. 5, description thereof will be omitted. The operation of the image forming device 1 performed by the processing of ACT 310, ACT 320, ACT 330, ACT 410, ACT 420, and ACT 430 shown in FIG. 6 is an example of the twenty-first operation.

In the flowchart shown in FIG. 6, after the processing of ACT 330 is performed, the control unit 100 transmits second abnormality notification information (ACT 410). The second abnormality notification information is, for example, information including lubricant depletion information. The second abnormality notification information may be information including information indicating that the motor signal value is out of the second range in place of the lubricant depletion information or in addition to the lubricant depletion information. The second abnormality notification information may include other information in addition to one or both of the two pieces of information. A transmission destination at which the control unit 100 transmits the second abnormality notification information in ACT 410 is an information processing device or the like communicably connected to the image forming device 1. The information processing device is, for example, a PC of a company that performs maintenance of the image forming device 1, an information processing terminal of an administrator who manages the image forming device 1, or the like, but is not limited thereto. The second abnormality notification information is an example of the notification information described above.

Next, the control unit 100 displays the second abnormality notification information (ACT 420). A display target on which the control unit 100 displays the second abnormality notification information in ACT 420 is the display unit of the control panel 12, a display unit of an information processing device communicably connected to the image forming device 1, and the like. The information processing device is, for example, a PC of a company that performs maintenance of the image forming device 1, an information processing terminal of an administrator who manages the image forming device 1, or the like, but is not limited thereto.

Next, the control unit 100 performs a third additional operation (ACT 430). The third additional operation may be any operation as long as the operation can be additionally performed to the image forming device 1 in addition to the operation of the image forming device 1 performed by the processing of ACT 310, ACT 320, ACT 330, ACT 410 and ACT 420 shown in FIG. 6. After the processing of ACT 430 is performed, the control unit 100 ends the processing of the flowchart shown in FIG. 6.

In the flowchart shown in FIG. 6, a part of the processing in ACT 310, ACT 320, ACT 330, ACT 410, ACT 420 and ACT 430 may be omitted.

In the flowchart shown in FIG. 6, a part or all of the processing in ACT 310, ACT 320, ACT 330, ACT 410, ACT 420 and ACT 430 may be performed in another order or may be performed in parallel.

As described above, the image forming device 1 according to the embodiment can drive the motor MT in the first operation mode and in the second operation mode different from the first operation mode. When the conveyance of the print medium is stopped during a period from the reception of the print job to completion of the conveyance of the print medium in accordance with the print job and when the motor MT is driven in the first operation mode, the image forming device 1 continues to drive the motor MT in the first operation mode, and performs the first operation when the magnitude of the signal output from the motor MT is out of the first range. When the conveyance of the print medium is stopped during a period from the reception of the print job to the completion of the conveyance of the print medium in accordance with the print job and when the motor MT is driven in the second operation mode, the image forming device 1 stops the driving of the motor MT in the second operation mode and then drives the motor MT in the first operation mode, and performs the first operation when the magnitude of the signal is out of the first range. Therefore, the image forming device 1 can perform an operation according to a defect occurring in the fixing device AD at a desired timing.

Figure 7:
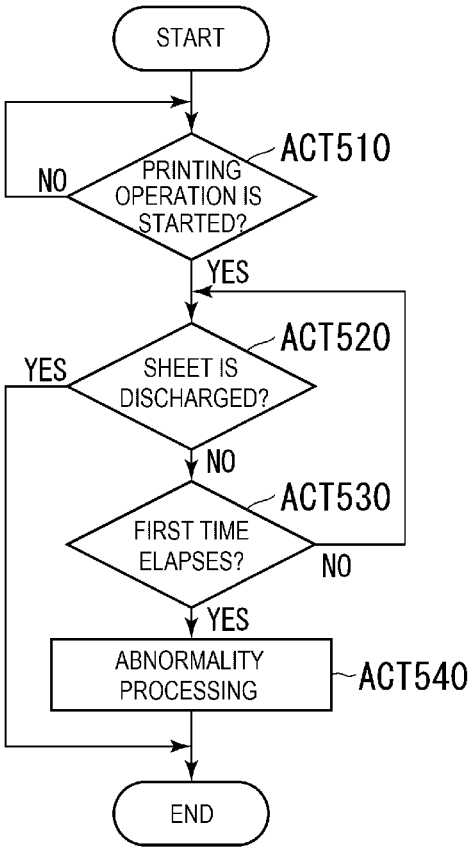
FIG. 7 is a diagram showing an example of a flow of a processing in which the image forming device 1 determines whether a defect occurs in a fixing device AD when a printing operation is not stopped.

(Processing of Image Forming Device Determining whether Defect Occurs in Fixing Device when Printing Operation is not Stopped) The processing of the flowchart shown in FIG. 4 is a processing of the image forming device 1 determining whether a defect occurs in the fixing device AD when the printing operation is stopped. The processing of the flowchart shown in FIG. 7 is a processing of the image forming device 1 determining whether a defect occurs in the fixing device AD when the printing operation is not stopped. That is, in this case, the image forming device 1 can also determine whether a defect occurs in the fixing device AD. FIG. 7 is a diagram showing an example of the flow of the processing in which the image forming device 1 determines whether the defect occurs in the fixing device AD when the printing operation is not stopped.

The control unit 100 waits until the printing operation is started (ACT 510).

If it is determined that the printing operation is started (Yes in ACT 510), the control unit 100 determines whether the print medium is discharged to the sheet discharge tray TB (ACT 520). For example, when the control unit 100 acquires, from the third detecting unit 43, information indicating that the discharge of the print medium to the sheet discharge tray TB is detected, the control unit 100 determines that the print medium is discharged to the sheet discharge tray TB. On the other hand, for example, when the control unit 100 does not acquire, from the third detecting unit 43, information indicating that the discharge of the print medium to the sheet discharge tray TB is detected, the control unit 100 determines that the print medium is not discharged to the sheet discharge tray TB. The information indicating that the discharge of the print medium to the sheet discharge tray TB is detected is an example of a signal output from the detection unit.

If it is determined that the print medium is discharged to the sheet discharge tray TB (Yes in ACT 520), the control unit 100 ends the processing of the flowchart shown in FIG. 7.

On the other hand, when it is determined that the print medium is not discharged to the sheet discharge tray TB (No in ACT 520), the control unit 100 determines whether a first time elapses after it is determined that the printing operation is started in ACT 510 (ACT 530). The first time is, for example, an average time required from the start of the printing operation to the discharge of the print medium to the sheet discharge tray TB. The first time is determined by experiment, theoretical calculation, or the like in advance.

If it is determined that the first time does not elapse since it is determined in ACT 510 that the printing operation is started (NO in ACT 530), the control unit 100 transitions to ACT 520 and determines again whether the print medium is discharged to the sheet discharge tray TB.

On the other hand, when it is determined that the first time elapses after it is determined that the printing operation is started in ACT 510 (YES in ACT 530), the control unit 100 performs abnormality processing (ACT 540). The abnormality processing is, for example, processing of performing at least one of the following four operations (1) to (4).

(1) An operation of outputting notification information to an information processing device communicably connected to the image forming device 1. The notification information is, for example, information including information indicating that a defect occurs in the fixing device AD. A transmission destination to which the control unit 100 transmits the notification information is an information processing device or the like communicably connected to the image forming device 1. The information processing device is, for example, a PC of a company that performs maintenance of the image forming device 1, an information processing terminal of an administrator who manages the image forming device 1, or the like, but is not limited thereto. The information processing terminal is a multifunctional mobile phone terminal (smartphone), a mobile phone terminal, a tablet PC, a notebook PC, a PDA, a desktop PC, or the like, but is not limited thereto. (2) An operation of displaying the notification information. A display target on which the control unit 100 displays the notification information is the display unit of the control panel 12, a display unit of an information processing device communicably connected to the image forming device 1, or the like. The information processing device is, for example, a PC of a company that performs maintenance of the image forming device 1, an information processing terminal of an administrator who manages the image forming device 1, or the like, but is not limited thereto. (3) An operation of stopping the formation of the image on the print medium. (4) An operation of stopping the driving of the fixing device AD.

The abnormality processing may include another operation in place of or in addition to a part or all of the four operations (1) to (4), or in addition to all of the four operations.

After the processing of ACT 540 is performed, the control unit 100 ends the processing of the flowchart shown in FIG. 7.

As described above, when the printing operation is not stopped, the image forming device 1 determines whether a defect occurs in the fixing device AD based on the signal output from the third detecting unit 43. Therefore, the image forming device 1 can more reliably perform an operation according to a defect occurring in the fixing device at a desired timing.

The control unit 100 may determine whether a defect occurs in the fixing device AD by using at least one of the signal output from the first detecting unit 41 and the signal output from the second detecting unit 42 in addition to the signal output from the third detecting unit 43.

The control unit 100 may determine whether a defect occurs in the two registration rollers 24 by using the signal output from the first detecting unit 41.

The control unit 100 may determine whether a defect occurs in at least one of the secondary transfer roller 23 and the intermediate transfer belt 20 by using the signal output from the second detecting unit 42.

(Modification 1 of Embodiment) Modification 1 of the embodiment will be described. In Modification 1 of the embodiment, the control unit 100 sets a threshold value THCA instead of the threshold value THAA, and sets a threshold value THCB instead of the threshold THAB. The threshold value THCA is a value smaller than the threshold value THAA by a predetermined ratio. For example, the threshold THCA is a value smaller than the threshold THAA by 10% of the threshold value THAA. The threshold value THCB is a value larger than the threshold value THAB by a predetermined ratio. For example, the threshold value THCB is a value larger than the threshold value THAB by 10% of the threshold value THAB. That is, the first range according to Modification 1 of the embodiment is a range narrower than the first range according to the embodiment, and is a range included inside the first range according to the embodiment.

In Modification 1 of the embodiment, the first abnormality notification information is, for example, information including information indicating that there is a high possibility that an abutment failure between the fixing member ADA and the pressing member ADB occurs in the fixing device AD driven by the motor MT, information indicating that the motor signal value is out of the first range, and the like. The first abnormality notification information may include other information in addition to one or both of the two pieces of information. In Modification 1 of the embodiment, the processing ACT 310, ACT 320, and ACT 330 are omitted from the first abnormality processing. In Modification 1 of the embodiment, the second abnormality notification information is, for example, information including information indicating that there is a high possibility that depletion of lubricant in the fixing member ADA occurs in the fixing device AD driven by the motor MT, information indicating that the motor signal value is out of the first range, and the like. The second abnormality notification information may include other information in addition to one or both of the two pieces of information. In Modification 1 of the embodiment, the processing ACT 310, ACT 320, and ACT 330 are omitted from the second abnormality processing. Therefore, the image forming device 1 can perform, by the first operation or a second operation, notification that there is a high possibility that a defect will occur in the fixing device AD, display that there is a high possibility that a defect will occur in the fixing device AD, and the like, before a defect will occur in the fixing device AD.

(Modification 2 of Embodiment) Modification 2 of the embodiment will be described. In Modification 2 of the embodiment, the control unit 100 may be configured to perform the determination processing of ACT 200 and ACT 230 shown in FIG. 4 using a machine learning model. In this case, at least one of the upper limit value of the first range and the lower limit value of the first range may be incorporated into a machine learning model.

(Modification 3 of Embodiment) Modification 3 of the embodiment will be described. In Modification 3 of the embodiment, the control unit 100 may perform the determination processing of ACT 200 and ACT 230 shown in FIG. 4 based on a detected difference value instead of performing the determination processing of ACT 200 and ACT 230 based on the motor signal value. The detected difference value is a difference value between the motor signal value and a predetermined reference value serving as a reference. When processing of ACT 200 is performed based on the detected difference value, the control unit 100 determines whether the detected difference value is smaller than a difference value between the threshold value THAB and the reference value in ACT 200. When processing of ACT 230 is performed based on the detected difference value, the control unit 100 determines whether the detected difference value is larger than a difference value between the threshold value THAA and the reference value in ACT 230.

Accordingly, even when a correspondence relationship between the drive current value and the motor signal value varies depending on an individual difference of the motor MT for each of a plurality of image forming devices 1, the image forming devices 1 can accurately perform the operation according to the defect occurring in the fixing device AD at a desired timing.

(Modification 4 of Embodiment) Modification 4 of the embodiment will be described. In Modification 4 of the embodiment, the difference between the first operation mode and the second operation mode is not the rotation speed of the motor MT but the magnitude of the pressing force.

The first operation mode in Modification 4 of the embodiment is an operation mode in which, when the pressing member ADB is pressed against the fixing member ADA by the biasing member, the motor MT is driven while pressing the pressing member ADB to the fixing member ADA side by a pressing force of a first magnitude. In other words, the first operation mode is an operation mode in which the motor MT is driven while the pressing member ADB and the fixing member ADA are brought into contact with each other by the pressing force of the first magnitude. For example, when forming an image on an A4 size plain paper, the image forming device 1 performs an operation of forming an image on the plain paper in the first operation mode. The pressing force of the first magnitude is, for example, 400 N. The pressing force of the first magnitude may be a force smaller than 400 N or a force larger than 400 N.

The second operation mode in Modification 4 of the embodiment is an operation mode in which, when the pressing member ADB is pressed against the fixing member ADA by the biasing member, the motor MT is driven while pressing the pressing member ADB to the fixing member ADA by a pressing force of a second magnitude. In other words, the second operation mode is an operation mode in which the motor MT is driven while the pressing member ADB and the fixing member ADA are brought into contact with each other by the pressing force of the second magnitude. For example, when forming an image on an A4 size thick paper, the image forming device 1 performs an operation of forming an image on the thick paper in the second operation mode. The pressing force of the second magnitude is, for example, 100 N. The pressing force of the second magnitude may be a force smaller than 100 N or a force larger than 100 N.

Figure 8:
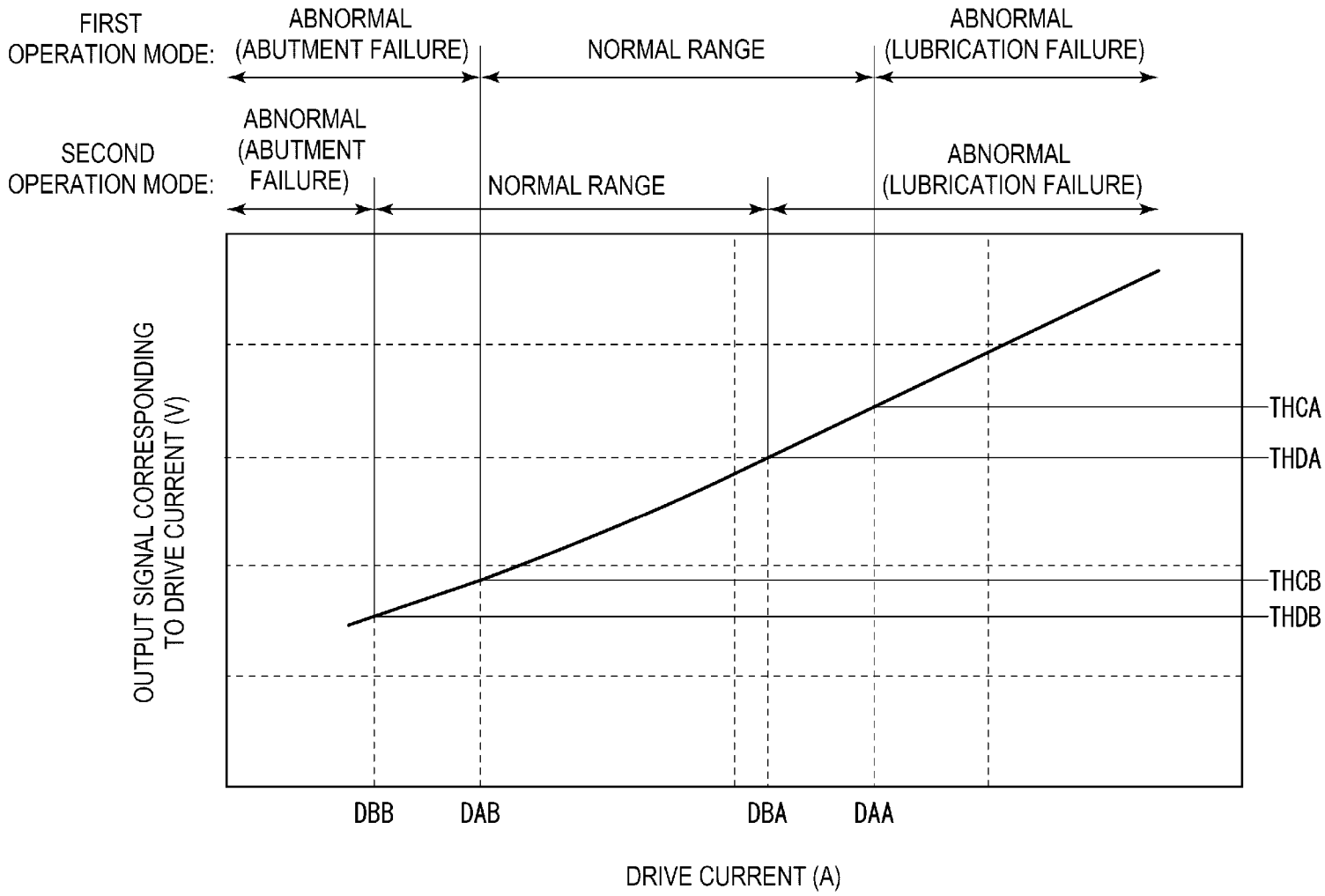
FIG. 8 is a diagram showing an example of a second correspondence relationship, which is a relationship between a drive current value and a motor signal value in Modification 4 of the embodiment.

FIG. 8 is a diagram showing an example of a second correspondence relationship. The second correspondence relationship is a relationship between the drive current value and the motor signal value in modification 4 of the embodiment.

A horizontal axis of the graph shown in FIG. 8 represents the drive current value. The drive current value changes according to the load of the motor MT. The vertical axis of the graph indicates the motor signal value. A solid line plotted on the graph indicates the second correspondence relationship when the image forming device 1 operates in the first operation mode and the second operation mode.

For example, when the operation mode of the image forming device 1 is the first operation mode and the fixing device AD driven by the motor MT operates normally, the drive current value indicates a value within a normal range from a value DAA to a value DAB shown in FIG. 8. For example, when the operation mode of the image forming device 1 is the first operation mode and an abutment failure between the fixing member ADA and the pressing member ADB occurs in the fixing device AD driven by the motor MT, the drive current value indicates a value smaller than the value DAB shown in FIG. 8. For example, when the operation mode of the image forming device 1 is the first operation mode and depletion of the lubricant in the fixing member ADA occurs in the fixing device AD driven by the motor MT, the drive current value indicates a value larger than the value DAA shown in FIG. 8.

For example, when the operation mode of the image forming device 1 is the second operation mode and the fixing device AD driven by the motor MT operates normally, the drive current value indicates a value within a normal range from a value DBA to a value DBB shown in FIG. 8. For example, when the operation mode of the image forming device 1 is the second operation mode and the abutment failure between the fixing member ADA and the pressing member ADB occurs in the fixing device AD driven by the motor MT, the drive current value indicates a value smaller than the value DBB shown in FIG. 8. For example, when the operation mode of the image forming device 1 is the second operation mode and the depletion of the lubricant in the fixing member ADA occurs in the fixing device AD driven by the motor MT, the drive current value indicates a value larger than the value DBA shown in FIG. 8.

A threshold value THCA shown in FIG. 8 indicates a motor signal value when the drive current value is the value DAA. A threshold value THCB shown in FIG. 8 indicates a motor signal value when the drive current value is the value DAB. A threshold value THDA shown in FIG. 8 indicates a motor signal value when the drive current value is the value DBA. A threshold value THDB shown in FIG. 8 indicates a motor signal value when the drive current value is the value DBB. For convenience of explanation, a range from the threshold value THCA to the threshold value THCB will be referred to as a third range. The third range is a modification of the first range in the embodiment. For convenience of explanation, a range from the threshold value THDA to the threshold value THDB will be referred to as a fourth range. The fourth range is a modification of the second range in the embodiment.

The fourth range is a range at least one of whose upper limit value and lower limit value is different from the third range. In the example shown in FIG. 8, both the upper limit value and the lower limit value of the fourth range are different from those of the third range. Therefore, when the operation mode of the image forming device 1 is the first operation mode, the control unit 100 can determine whether the motor signal value is out of the third range by using the threshold value THCA and the threshold value THCB. When the operation mode of the image forming device 1 is the second operation mode, the control unit 100 can determine whether the motor signal value is out of the fourth range by using the threshold value THDA and the threshold value THDB.

By using the third range and the fourth range, the image forming device 1 performs the first operation by performing the processing of the flowchart shown in FIG. 4. However, in Modification 4 of the embodiment, as described below, a part of the processing of the flowchart is changed.

In Modification 4 of the embodiment, when the magnitude of the pressing force matches the magnitude of the pressing force corresponding to the operation mode of the current image forming device 1 in ACT 140 shown in FIG. 4, the control unit 100 determines that the abutment operation started in ACT 130 is completed. For example, in ACT 140, when the current operation mode of the image forming device 1 is the first operation mode, when the magnitude of the pressing force is equal to 400 N, the control unit 100 determines that the abutment operation is completed. However, in this case, when the pressing force is included in an error range having a center value of 400N, the control unit 100 determines that the magnitude of the pressing force is equal to 400 N. The error range is, for example, an error range of ±10%, but is not limited thereto. On the other hand, for example, in ACT 140, when the current operation mode of the image forming device 1 is the second operation mode, when the magnitude of the pressing force is equal to 100 N, the control unit 100 determines that the abutment operation is completed. However, in this case, when the pressing force is included in an error range having a center value of 100N, the control unit 100 determines that the magnitude of the pressing force is equal to 100 N. The error range is, for example, an error range of ±10%, but is not limited thereto.

In Modification 4 of the embodiment, in ACT 150 shown in FIG. 4, the control unit 100 drives the motor MT at a predetermined rotation speed to start the rotation of the pressing member ADB.

As described above, the image forming device 1 according to modification 4 of the embodiment can perform the first operation when the motor signal value is out of the third range in the case of operating in the first operation mode, and can perform the second operation when the motor signal value is out of the fourth range in the case of operating in the second operation mode. As a result, the image forming device 1 can perform the operation according to a defect occurring in the fixing device AD at a desired timing.

(Other Modifications) In the embodiment described above or each of the modifications of the embodiment, the difference between the first operation mode and the second operation mode may be the nip pressure of the nip formed by the fixing member ADA and the pressing member ADB in the fixing device AD.

In the embodiment described above or each of the modifications of the embodiment, the difference between the first operation mode and the second operation mode may be the nip pressure of the nip formed by the fixing member ADA and the pressing member ADB in the fixing device AD. This is because a load of the motor MT also changes due to a difference in nip pressure.

In the embodiment described above or each of the modifications of the embodiment, the difference between the first operation mode and the second operation mode may be a heating target temperature of the fixing member ADA by the heating unit HT. This is because a viscosity of the lubricant changes due to a change in the temperature of the fixing member ADA, and as a result, a load of the motor MT changes.

The embodiments and the modifications of the embodiments described above may be combined in any manner.

As described above, the image forming device (in the example described above, the image forming device 1) includes: the conveyance unit configured to convey the print medium; the image forming unit (in the example described above, the image forming unit 114) configured to form the toner image of the target image on the print medium conveyed by the conveyance unit; the fixing device (in the example described above, the fixing device AD) configured to heat the print medium on which the toner image is formed by the image forming unit, and fix the toner image as the target image to the print medium; the motor (in the example described above, the motor MT) configured to drive the fixing device and output the signal having the magnitude corresponding to the value of the drive current; the control unit (in the example described above, the control unit 100) configured to: drive the motor in the first operation mode and the second operation mode different from the first operation mode, when the conveyance of the print medium is stopped during the period from reception of the instruction to form the target image on the print medium (in the example described above, the printing job) to completion of the conveyance of the print medium according to the instruction and when the motor is driven in the first operation mode, continue to drive the motor in the first operation mode, and perform the first operation when the magnitude of the signal is out of the first range, and when the conveyance of the print medium is stopped during the period from the reception of the instruction to the completion of the conveyance of the print medium according to the instruction and when the motor is driven in the second operation mode, stop driving the motor in the second operation mode and then drive the motor in the first operation mode, and perform the first operation when the magnitude of the signal is out of the first range. Thereby, the image forming device can perform an operation according to a defect occurring in the fixing device at a desired timing.

In the image forming device, a configuration may be used in which the first operation mode is an operation mode in which the motor is driven at the first rotation speed (1500 rpm in the example described above), and the second operation mode is an operation mode in which the motor is driven at the second rotation speed (940 rpm in the example described above) different from the first rotation speed.

In the image forming device, a configuration may be used in which the fixing device includes the heating unit (in the example described above, the heating unit HT); the fixing member (in the example described above, the fixing member ADA) heated by the heating unit; and the pressing member (in the example described above, the pressing member ADB) that comes into contact with the fixing member to form the nip with the fixing member, in which the first operation mode is an operation mode in which the motor is driven while the pressing member and the fixing member are in contact with each other under a first force (in the example described above, 400 N), and the second operation mode is an operation mode in which the motor is driven while the pressing member and the fixing member are in contact with each other under a second force (in the example described above, 100 N) which is different from the first force.

In the image forming device, a configuration may be used in which the first operation includes the operation of outputting notification information including information indicating that a defect occurs in the fixing device to the information processing device.

In the image forming device, a configuration may be used in which the first operation includes an operation related to the magnitude of the signal output from the motor deviating from the first range.

The image forming device may include the detecting unit (in the example described above, the third detecting unit 43) configured to detect whether the print medium passes through the first position on the conveyance path on which the print medium is conveyed; and the control unit determines whether the defect occurs in the fixing device based on the signal output from the detecting unit.

While several embodiments have been described, these embodiments have been presented by way of example and are not intended to limit the scope of the present disclosure. These embodiments can be carried out in various other forms, and various omissions, replacements and modifications can be made thereto without departing from the scope of the disclosure. The accompanying claims and their equivalents are intended to cover these embodiments or modifications as would fall within the scope and spirit of the disclosure.

A program for implementing functions of arbitrary components in the device (for example, the image forming device 1) described above may be recorded in a computer-readable recording medium, and the program may be read and executed by a computer system. The "computer system" mentioned here includes an operating system (OS) and hardware such as peripheral devices. The "computer-readable recording medium" refers to a storage device such as a portable medium such as a flexible disk, a magneto-optical disk, a ROM, and a compact disk (CD)-ROM, and a hard disk built in the computer system. The "computer-readable recording medium" includes a recording medium that retains a program for a certain period of time, such as a volatile memory (RAM) inside a computer system serving as a server or a client when the program is transmitted via a network such as the Internet or a communication line such as a telephone line.

The program may be transmitted from a computer system in which the program is stored in a storage device or the like to another computer system via a transmission medium or by transmission waves in the transmission medium. The "transmission medium" that transmits the program refers to a medium having a function of transmitting information, such as a network (communication network) such as the Internet or a communication line such as a telephone line. The above-described program may be a program for implementing a part of the above-described functions. The above-described program may be a so-called differential file (differential program) that can implement the above-described functions in combination with a program already recorded in the computer system.

What is claimed is:

1. An image forming device, comprising:

a conveyance component configured to convey a print medium;

an image forming component configured to form a toner image of a target image on the print medium conveyed by the conveyance component;

a fixing device configured to heat the print medium on which the toner image is formed by the image forming component, and fix the toner image as the target image to the print medium;

a motor configured to drive the fixing device and output a signal having a magnitude corresponding to a value of a drive current; and a controller configured to:

drive the motor in a first operation mode at a first rotation speed and a second operation mode at a second rotation speed slower than the first rotation speed, when conveyance of the print medium in the first operation mode is stopped during a period from reception of an instruction to form the target image on the print medium to completion of the conveyance of the print medium according to the instruction and the motor is driven at the first rotation speed, continue to drive the motor at the first rotation speed and perform a first operation when the magnitude of the signal is outside of a first range in the first operation mode, and when the conveyance of the print medium in the second operation mode is stopped during the period from the reception of the instruction to the completion of the conveyance of the print medium according to the instruction and the motor is driven at the second rotation speed, drive the motor at the first rotation speed after stopping driving the motor and perform the first operation when the magnitude of the signal is outside of the first range in the first operation mode.

2. The image forming device according to claim 1, wherein the first operation mode is an operation mode in which the motor is driven at a first rotation speed for a plain paper, and the second operation mode is an operation mode in which the motor is driven at a second rotation speed for a thick paper.

3. The image forming device according to claim 1, wherein the fixing device comprises:

a heating component;

a fixing member configured to be heated by the heating component; and a pressing member configured to come into contact with the fixing member to form a nip together with the fixing member, wherein the first operation mode is an operation mode in which the motor is driven while the pressing member and the fixing member are in contact with each other under a first force, and the second operation mode is an operation mode in which the motor is driven while the pressing member and the fixing member are in contact with each other under a second force which is different from the first force.

4. The image forming device according to claim 1, wherein the first operation includes an operation of outputting notification information including information indicating that a defect occurs in the fixing device to an information processing device.

5. The image forming device according to claim 1, further comprising:

a detector configured to detect whether the print medium passes through a first position on a conveyance path on which the print medium is conveyed, wherein the controller is configured to determine whether a defect occurs in the fixing device based on a signal output from the detector.

6. The image forming device according to claim 1, wherein the image forming component is configured to form at least one of a black image, a cyan image, a magenta image and a yellow image.

7. An image forming method, comprising:

conveying a print medium by a conveyance component;

forming a toner image of a target image on the print medium;

heating the print medium on which the toner image is formed, and fixing the toner image as the target image to the print medium;

driving a fixing device using a motor and outputting a signal having a magnitude corresponding to a value of a drive current;

driving the motor in a first operation mode at a first rotation speed and a second operation mode at a second rotation speed slower than the first rotation speed;

when conveying the print medium in the first operation mode is stopped during a period from reception of an instruction to form the target image on the print medium to completion of the conveyance of the print medium according to the instruction and the motor is driven at the first rotation speed, continuing to drive the motor at the first rotation speed and performing a first operation when the magnitude of the signal is outside of a first range in the first operation mode; and when conveying the print medium in the second operation mode is stopped during the period from the reception of the instruction to the completion of the conveyance of the print medium according to the instruction and the motor is driven at the second rotation speed, driving the motor at the first rotation speed after stopping driving the motor and performing the first operation when the magnitude of the signal is outside of the first range in the first operation mode.

8. The image forming method according to claim 7, wherein the first operation mode is an operation mode in which the motor is driven at a first rotation speed for a plain paper, and the second operation mode is an operation mode in which the motor is driven at a second rotation speed for a thick paper.

9. The image forming method according to claim 7, further comprising:

heating a fixing member; and bringing a pressing member into contact with the fixing member to form a nip together with the fixing member, wherein the first operation mode is an operation mode in which the motor is driven while the pressing member and the fixing member are in contact with each other under a first force, and the second operation mode is an operation mode in which the motor is driven while the pressing member and the fixing member are in contact with each other under a second force which is different from the first force.

10. The image forming method according to claim 7, wherein the first operation includes an operation of outputting notification information including information indicating that a defect occurs in the fixing device to an information processing device.

11. The image forming method according to claim 7, further comprising:

detecting whether the print medium passes through a first position on a conveyance path on which the print medium is conveyed; and determining whether a defect occurs in fixing based on a signal output.

12. The image forming method according to claim 7, further comprising:

forming at least one of a black image, a cyan image, a magenta image and a yellow image.

13. A control system for an image forming device, comprising:

an image forming component configured to form a toner image of a target image on a print medium conveyed by a conveyance component;

a fixing device configured to heat the print medium on which the toner image is formed by the image forming component, and fix the toner image as the target image to the print medium;

a motor configured to drive the fixing device and output a signal having a magnitude corresponding to a value of a drive current; and a controller configured to:

drive the motor in a first operation mode at a first rotation speed and a second operation mode at a second rotation speed slower than the first rotation speed, when conveyance of the print medium in the first operation mode is stopped during a period from reception of an instruction to form the target image on the print medium to completion of the conveyance of the print medium according to the instruction and the motor is driven at the first rotation speed, continue to drive the motor at the first, rotation speed and perform a first operation when the magnitude of the signal is outside of a first range in the first operation mode, and when the conveyance of the print medium in the second operation mode is stopped during the period from the reception of the instruction to the completion of the conveyance of the print medium according to the instruction and the motor is driven at the second rotation speed, drive the motor at the first rotation speed after stopping driving the motor and perform the first operation when the magnitude of the signal is outside of the first range in the first operation mode.

14. The control system according to claim 13, wherein the first operation mode is an operation mode in which the motor is driven at a first rotation speed for a plain paper, and the second operation mode is an operation mode in which the motor is driven at a second rotation speed for a thick paper.

15. The control system according to claim 13, wherein the fixing device comprises:

a heating component;

a fixing member configured to be heated by the heating component; and a pressing member configured to come into contact with the fixing member to form a nip together with the fixing member, wherein the first operation mode is an operation mode in which the motor is driven while the pressing member and the fixing member are in contact with each other under a first force, and the second operation mode is an operation mode in which the motor is driven while the pressing member and the fixing member are in contact with each other under a second force which is different from the first force.

16. The control system according to claim 13, wherein the first operation includes an operation of outputting notification information including information indicating that a defect occurs in the fixing device to an information processing device.

17. The control system according to claim 13, further comprising:

a detector configured to detect whether the print medium passes through a first position on a conveyance path on which the print medium is conveyed, wherein the controller is configured to determine whether a defect occurs in the fixing device based on a signal output from the detector.

18. The control system according to claim 13, wherein the image forming component is configured to form at least one of a black image, a cyan image, a magenta image and a yellow image.

* * * * *